US007870962B2

(12) United States Patent
Law

(10) Patent No.: US 7,870,962 B2
(45) Date of Patent: Jan. 18, 2011

(54) MULTI-FUNCTIONAL STORAGE APPARATUS

(76) Inventor: Hung Hi Law, Rm 505, 5/F, Goodluck Ind. Ctr., 808 Lai Chi Kok Road, Kowloon, Hong Kong (HK)

( * ) Notice: Subject to any disclaimer, the term of this patent is extended or adjusted under 35 U.S.C. 154(b) by 0 days.

(21) Appl. No.: 12/621,479

(22) Filed: Nov. 18, 2009

(65) Prior Publication Data

US 2010/0059405 A1 Mar. 11, 2010

Related U.S. Application Data

(62) Division of application No. 11/752,461, filed on May 23, 2007, now Pat. No. 7,661,535.

(30) Foreign Application Priority Data

Dec. 27, 2006 (CN) ..... 2006 2 0164664 U

(51) Int. Cl.
*B65D 81/02* (2006.01)

(52) U.S. Cl. ..... 206/578; 206/316.2; 206/477; 352/242; 396/420

(58) Field of Classification Search ..... 206/316.1, 206/316.2, 736, 759, 764, 45.2, 45.23, 305, 206/320, 477, 493, 578; 224/664, 908; 352/242, 352/243; 396/419–421, 424, 429
See application file for complete search history.

(56) References Cited

U.S. PATENT DOCUMENTS

| | | | | | |
|---|---|---|---|---|---|
| 2,679,196 | A | * | 5/1954 | Sochor et al. | 396/401 |
| 3,242,840 | A | * | 3/1966 | Kremp et al. | 396/424 |
| 3,291,179 | A | * | 12/1966 | Lang | 206/316.2 |
| 4,050,796 | A | * | 9/1977 | Komine | 352/243 |
| 5,064,062 | A | * | 11/1991 | Miller | 206/316.2 |
| 5,598,963 | A | * | 2/1997 | Buswell | 224/664 |
| 5,738,256 | A | * | 4/1998 | Goff et al. | 224/185 |

* cited by examiner

*Primary Examiner*—Luan K Bui
(74) *Attorney, Agent, or Firm*—Tsz Lung Yeung

(57) ABSTRACT

A multi-functional storage apparatus for selectively supporting a capturing device includes a main casing having a receiving cavity and a supporting arrangement. The supporting arrangement is provided on the main casing to operate the main casing between a normal storing mode and an capturing mode, wherein in the normal storing mode, the supporting arrangement is arranged to rest on the main casing so as to allow the main casing to function as a portable carrying device through storing objects within the receiving cavity, wherein in the capturing mode, the supporting arrangement is selectively extended from the main casing to detachably attach to the image capturing device, in such a manner that the image capturing device is securely and suspendedly supported by the main casing as a supporting base for stably capturing image in a predetermined direction.

4 Claims, 11 Drawing Sheets

MULTI-FUNCTIONAL STORAGE APPARATUS

CROSS REFERENCE OF RELATED APPLICATION

This is a divisional application of a non-provisional application having an application number of 11/752,461 filed May 23, 2007, now U.S. Pat. No. 7,661,535, which claimed foreign priority of application number 200620164664.2 and filing date of Dec. 27, 2006 filed in China.

BACKGROUND OF THE PRESENT INVENTION

1. Field of Invention

The present invention relates to a capturing device such as a camera, and more particularly to a multi-functional storage apparatus for selectively supporting that capturing device in outdoor environment.

2. Description of Related Arts

When people go out, they generally take with them a handbag for storing various personal accessories, such as keys, mobile phones, cameras, napkins etc. A conventional handbag usually comprises a main body having a storing cavity formed therein for storing the personal accessories, some of which have become extremely popular in recent years. For example, with the advance of information technology, video or image capturing devices, such as digital cameras and digital video recording devices, have widely been utilized in many occasions for allowing the users to rapidly and conveniently capture short videos and images in their daily life.

A major disadvantage in using such digital accessories in outdoor environment is that in order to capture a short video clip or images with their digital accessories, such as the digital cameras or video capturing devices, the users require a secure and stable support. For example, when a user needs to capture a particular scene during nighttime, he or she may need to set his or her digital camera to have an extended exposure time for capturing a high-quality or even an acceptable night time scene. In such a situation, the user may need to hold the digital camera very stably so as not to make the captured image blurry. If the user is unable to do so, he or she may need to put his or her camera in a stable and secure place where it can act as a supporting platform for the digital camera. This is both inconvenient and time-consuming. In many occasions, the user simply cannot find such a place.

Conventionally, a tripod may be used for supporting the digital camera in an elevated and stable position so that the digital camera can capture a particular image very stably and produce a high quality picture or photograph. Needless to say, however, that a conventional tripod is usually very bulky and heavy, so that it is inconvenient to carry and transport.

SUMMARY OF THE PRESENT INVENTION

A main object of the present invention is to provide a multi-functional storage apparatus for selectively supporting a camera in outdoor environment.

Another object of the present invention is to provide a multi-functional storage apparatus which comprises a main casing and a supporting arrangement for operating the main casing between a normal storing mode that the main casing is adapted to act as a conventional portable carrying device, and a capturing mode that the supporting arrangement is adapted to extend from the main casing for securely and stably supporting a capturing device in a suspended manner for capturing an image or a video.

Another object of the present invention is to provide a multi-functional storage apparatus which is adapted to be conveniently and easily transported when the main casing is in the normal storing mode so as not to interfere with the daily activities of the users of the present invention.

Another object of the present invention is to provide a multi-functional storage apparatus which does not employ complicated mechanical structure. Thus, the manufacturing cost of the present invention can be effectively minimized.

Thus, the present invention provides a multi-functional storage apparatus for selectively supporting a capturing device, comprising:

a main casing having a receiving cavity formed therein; and a supporting arrangement provided on the main casing to operate the main casing between a normal storing mode and a capturing mode, wherein in the normal storing mode, the supporting arrangement is arranged to rest on the main casing so as to allow the main casing to function as a portable carrying device through storing objects within the receiving cavity, wherein in the capturing mode, the supporting arrangement is selectively extended from the main casing to detachably attach to the capturing device, in such a manner that the capturing device is securely and suspendedly supported by the main casing as a supporting base for stably capturing image in a predetermined direction.

The above mentioned objectives, features, and advantages of the present invention will be more clearly described and shown in the following detailed description, drawings, and the appended claims.

DETAILED DESCRIPTION OF THE PREFERRED EMBODIMENT

Figure 1:
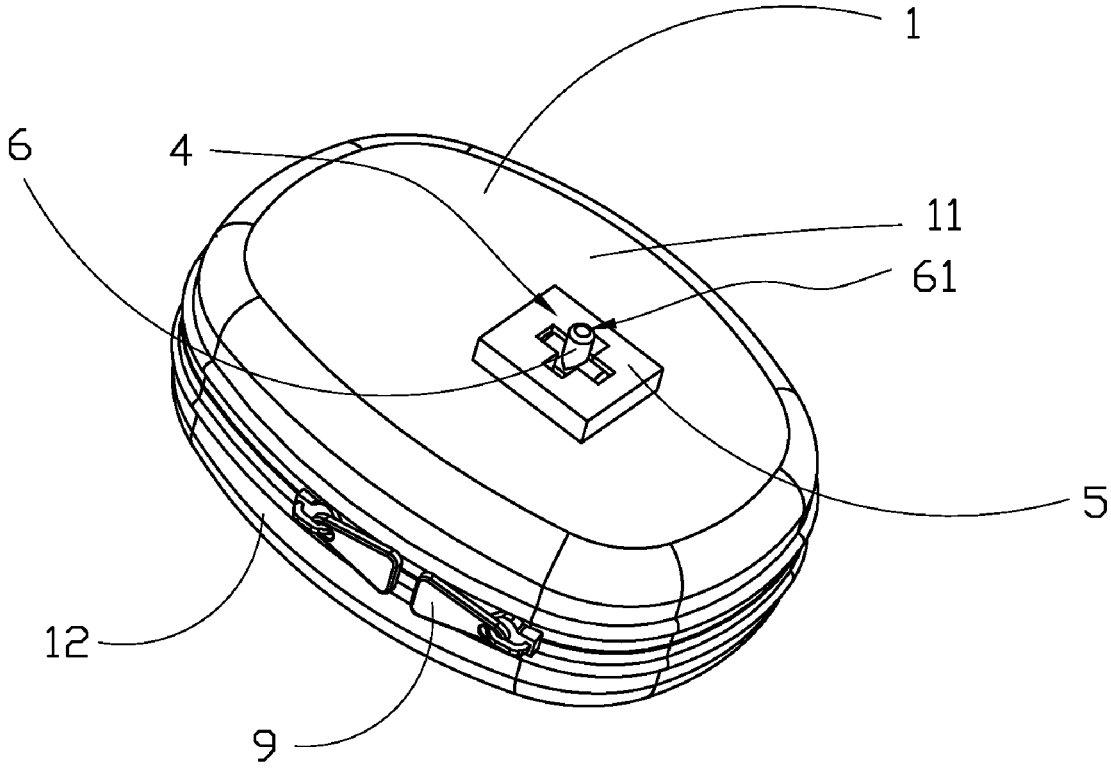
FIG. 1 is a perspective view of a multi-functional storage apparatus according to a preferred embodiment of the present invention.
Figure 2:
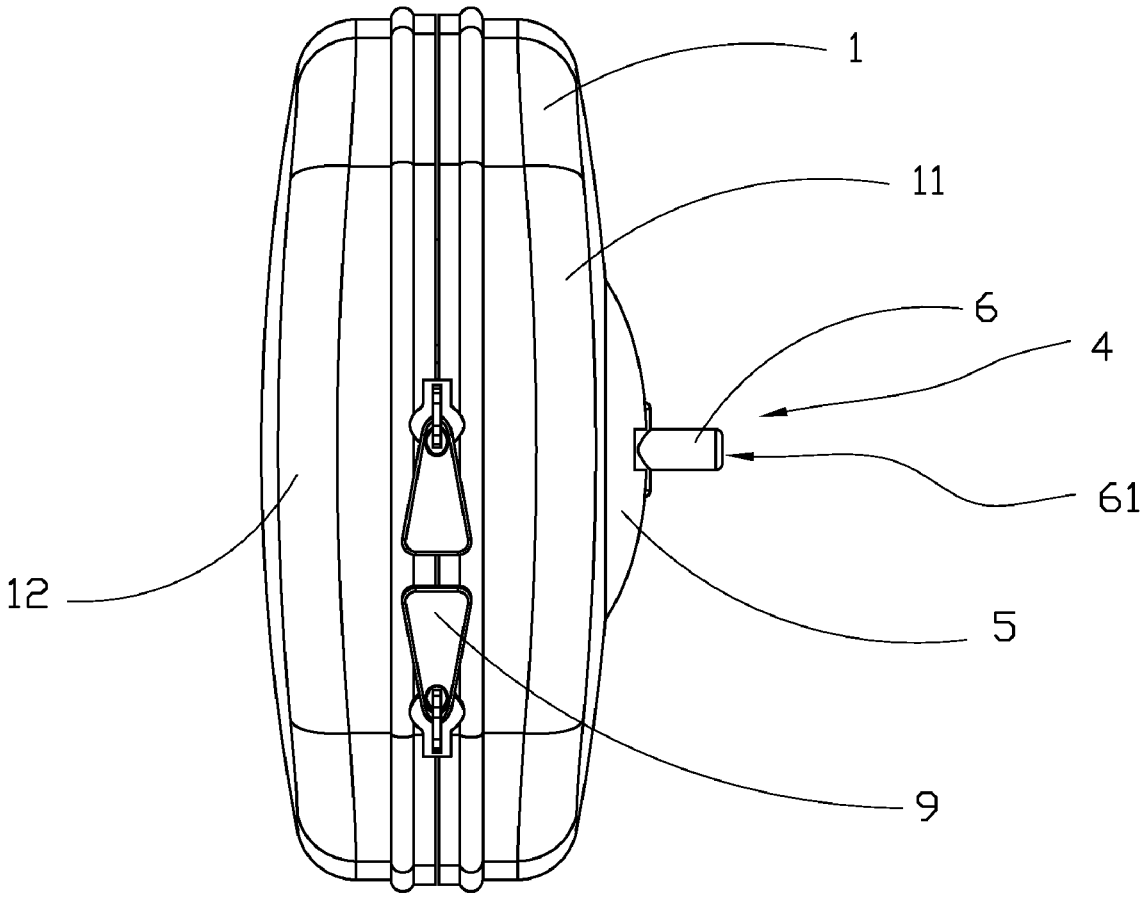
FIG. 2 is a schematic side view of the multi-functional storage apparatus according to the preferred embodiment of the present invention.
Figure 11:
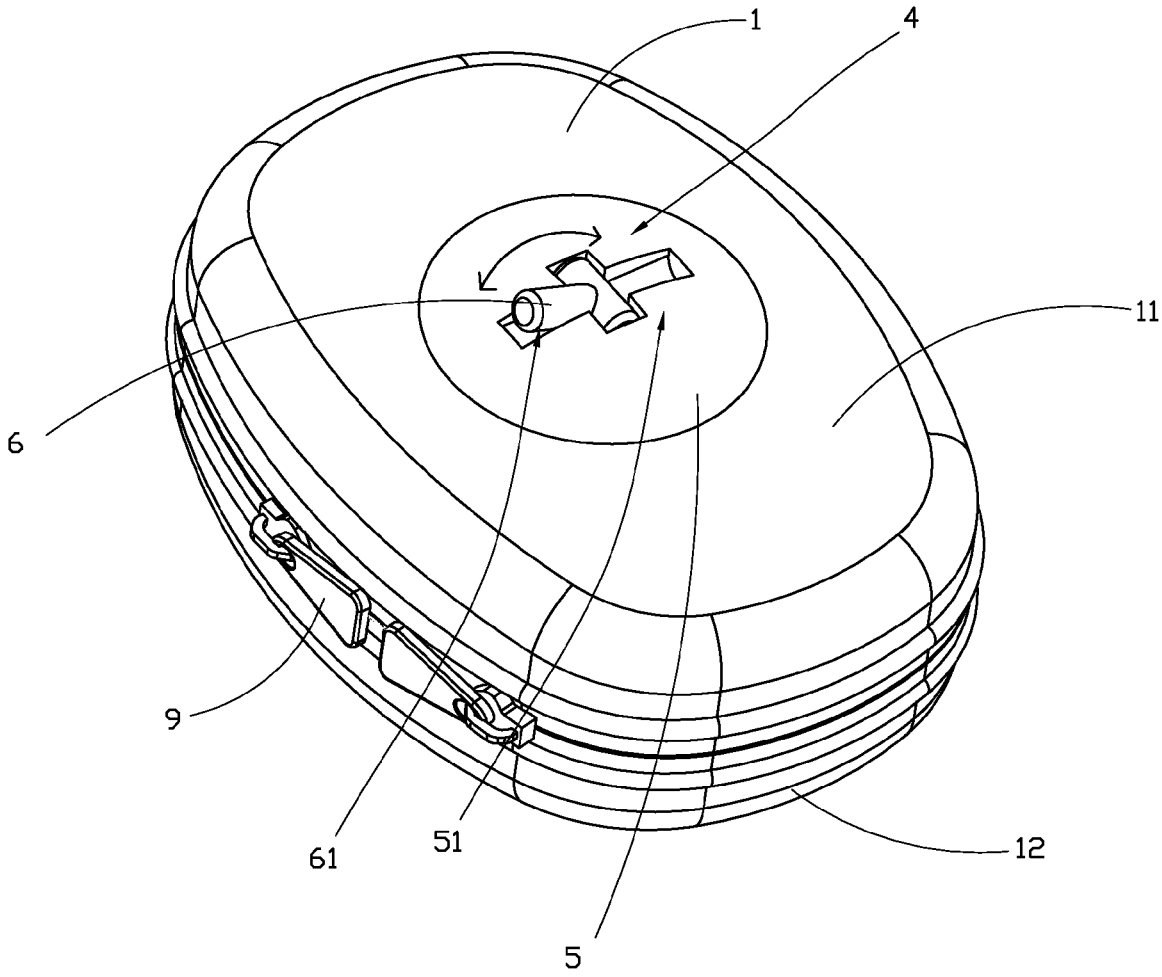
FIG. 11 is a schematic diagram of the multi-functional storage apparatus according to the preferred embodiment of the present invention, illustrating that the elongated connecting member can be selectively received into the main casing.

Referring FIG. 1, FIG. 2 and FIG. 11 of the drawings, a multi-functional storage apparatus for selectively supporting a capturing device is illustrated, in which the multi-storage apparatus comprises a main casing 1 having a receiving cavity and a supporting arrangement. The multi-functional storage apparatus is for a capturing device, such as an image capturing device (e.g. a digital camera) or a video capturing device (e.g. a digital video recorder).

The supporting arrangement is provided on the main casing 1 to operate the main casing 1 between a normal storing mode and an capturing mode, wherein in the normal storing mode, the supporting arrangement is arranged to rest on the main casing 1 so as to allow the main casing 1 to function as a portable carrying device through storing objects within the receiving cavity, wherein in the capturing mode, the supporting arrangement is selectively extended from the main casing 1 to detachably attach to the image capturing device, in such a manner that the image capturing device is securely and suspendedly supported by the main casing 1 as a supporting base for stably capturing image in a predetermined direction.

According to the preferred embodiment of the present invention, the main casing 1 is shaped and sized to normally store a plurality of personal accessories, such as coins, napkins, keys etc in a conveniently portable manner. Alternatively, the main casing 1 may also be utilized to store the capturing device so as to normally protect it from ambient environment. Referring to FIG. 1 of the drawings, the main casing 1 comprises a first and a second case members 11, 12 movably coupled with each other to define the receiving cavity between the first and the second case members 11, 12 within the main casing 1. Furthermore, the main casing 1 further comprises a zipping member 9 connecting a peripheral edge portion of each of the first and the second case members 11, 12 so as to selectively enclose the receiving cavity by the first and the second case members 11, 12.

As shown in FIG. 11 of the drawings, the supporting arrangement comprises a supporting frame 4 which may be movably extended from an outer surface of the main casing 1, wherein when the main casing 1 is in the normal storing mode, the supporting frame 4 can be moved to align with the outer surface of the main casing 1 for resting thereon, and when the main casing 1 is in the capturing mode, the supporting frame 4 can be driven to extend from the outer surface of the main casing 1 to detachably attach to the capturing device for suspendedly and securely supporting the capturing device on the main casing. As such, a user of the present invention is able to utilize the capturing device for securely capturing an image or video in a stable manner.

The supporting frame 4 comprises a reinforcing base 5 mounted on the corresponding surface of the main casing 1, and an elongated connecting member 6 rotatably extended from the reinforcing base 5 to detachably couple with the capturing device. In order to enhance an aesthetic appearance of the present invention and to ensure maximum convenience of using the multi-functional storage apparatus, the reinforcing base 5 has a receiving slot 51 indently formed thereon to normally receive the elongated connecting member 6 within the receiving slot 51 when the main casing 1 is in the normal storing mode. However, when the main casing 1 is in the capturing mode, the elongated connecting member 6 is adapted to be pivotally moved to extend from the reinforcing base 5 for securely and stably supporting the capturing device on the main casing 1.

According to the preferred embodiment of the present invention, the elongated connecting member 6 has a threaded outer portion 61 defining a plurality of screwing teeth thereon. Accordingly, the elongated connecting member 6 is adapted for detachably coupling with a threaded connecting hole of the capturing device so as to detachably attach onto the capturing device. In other words, when the main casing 1 is in the capturing mode, a user is able to detachably connect the capturing device with the supporting frame 4 by screwing or unscrewing the threaded outer portion 61 into or from the threaded hole formed on the capturing device respectively.

The operation of the present invention is as follows: when the main casing 1 is in the normal storing mode, the elongated connecting member 6 is hidden into the receiving slot 51, and the main casing 1 functions as a conventional portable carrying device, such as a handbag. The user of the present invention is allowed to store personal accessories into the receiving cavity of the main casing 1. When the user wishes to take picture in a particular direction, he or she may rotatably extend the elongated connecting member 6 and screwing the outer threaded portion 61 thereof to a threaded hole of the capturing device. The user is then able to detachably attach the capturing device to the supporting frame 4 which, along with the main casing 1, acts as a supporting base for securely and stably holding the capturing device in position. After that, the user is able to capture an image by the capturing device in a stable and secure manner so as to perform a high-quality image capturing. It is worth mentioning that since the main casing 1 is normally storing personal accessories, the weight of those personal accessories provides a secure supporting weight for the capturing device. Moreover, the main casing 1 can also be designed and crafted to store the capturing device within the receiving cavity, so that the user can normally carry the capturing device by the main casing 1, and when he or she needs to capture an image, he or she may simply take out the capturing device from the receiving cavity and detachably connect it with the supporting arrangement. In such a situation, the main casing 1 should be shaped and sized to correspond with a size of a predetermined capturing device, so as to allow convenient and easy carrying of the capturing device.

Figure 3:
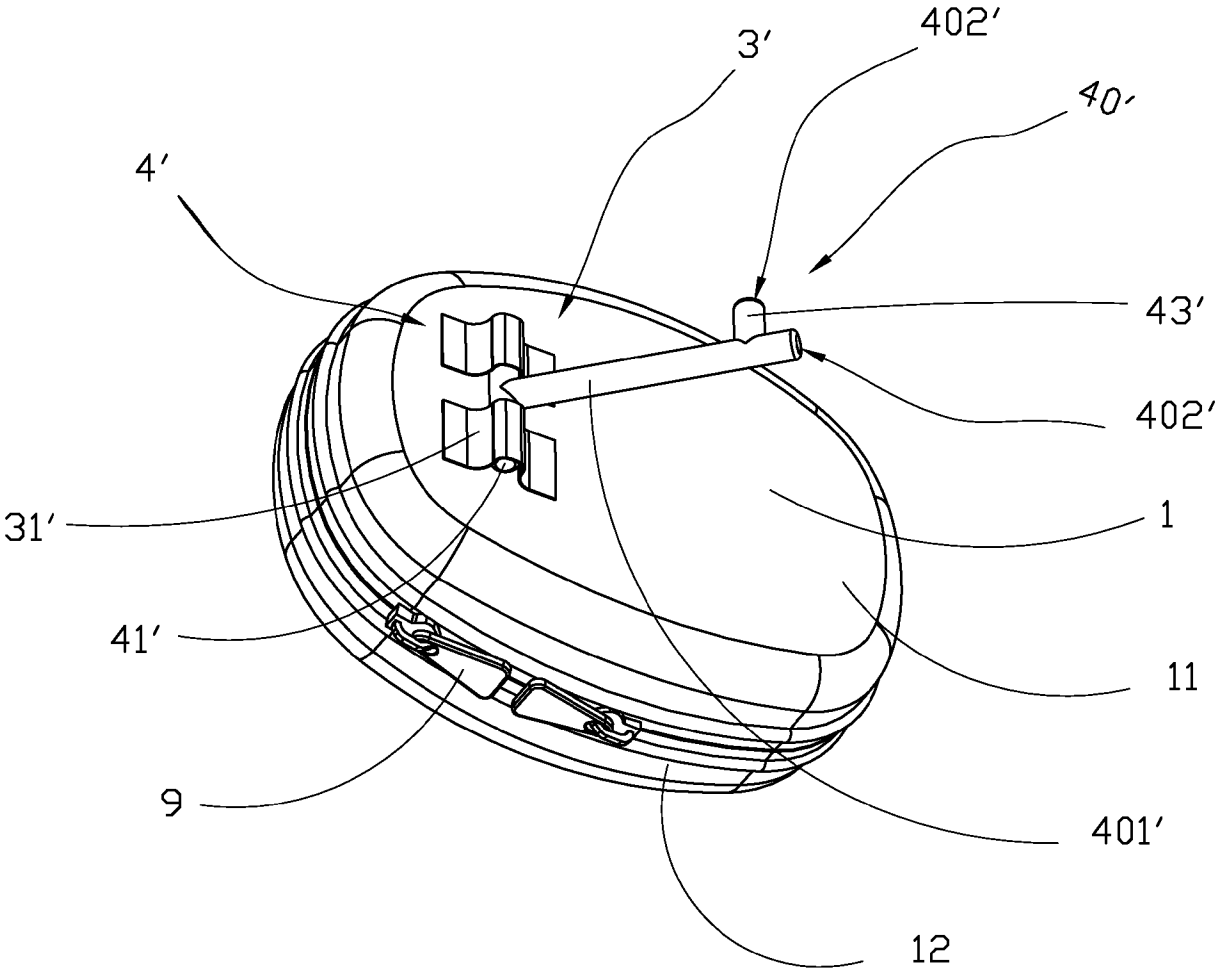
FIG. 3 is a first alternative mode of the multi-functional storage apparatus according to the preferred embodiment of the present invention.
Figure 4:
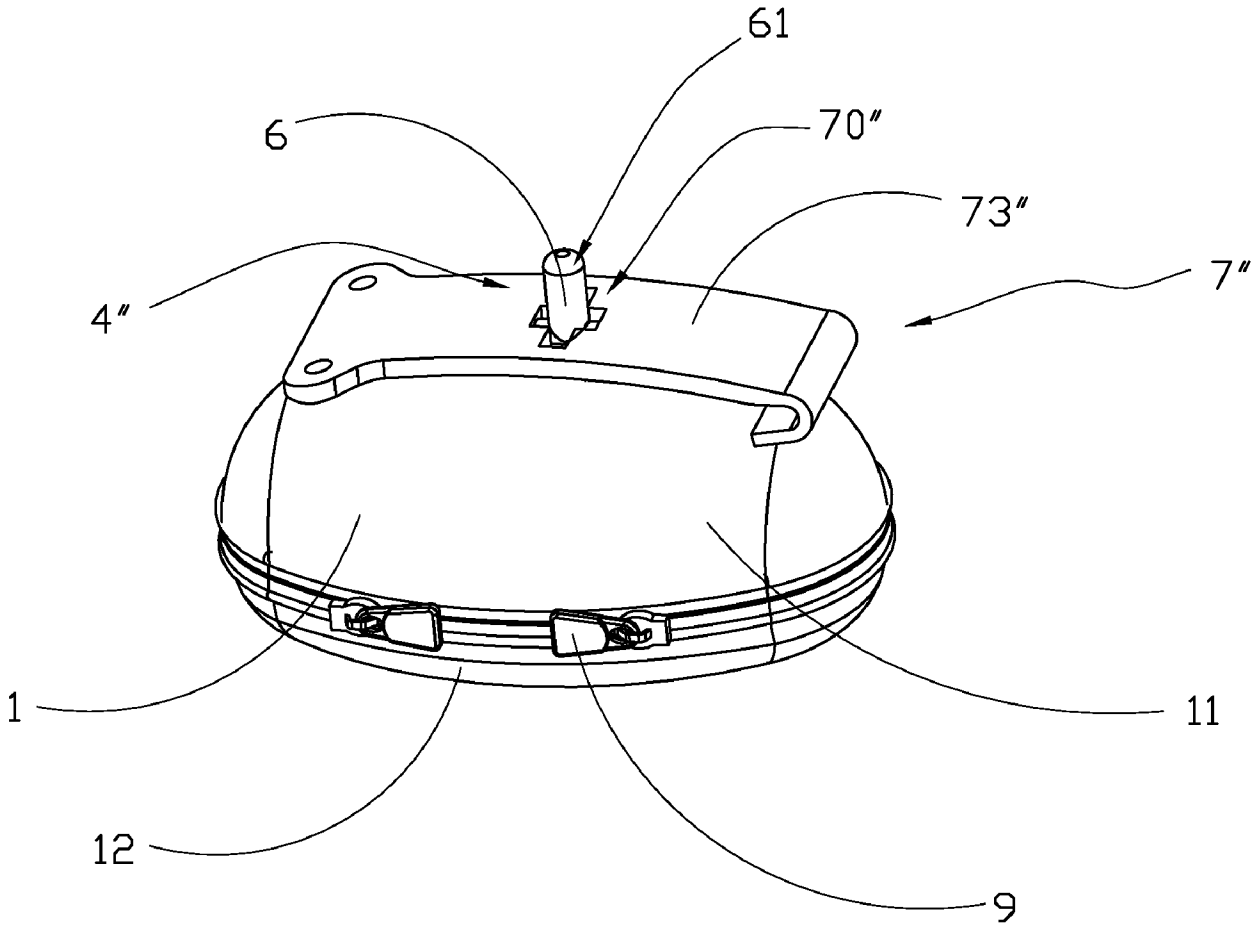
FIG. 4 is a second alternative mode of the multi-functional storage apparatus according to the preferred embodiment of the present invention.
Figure 5:
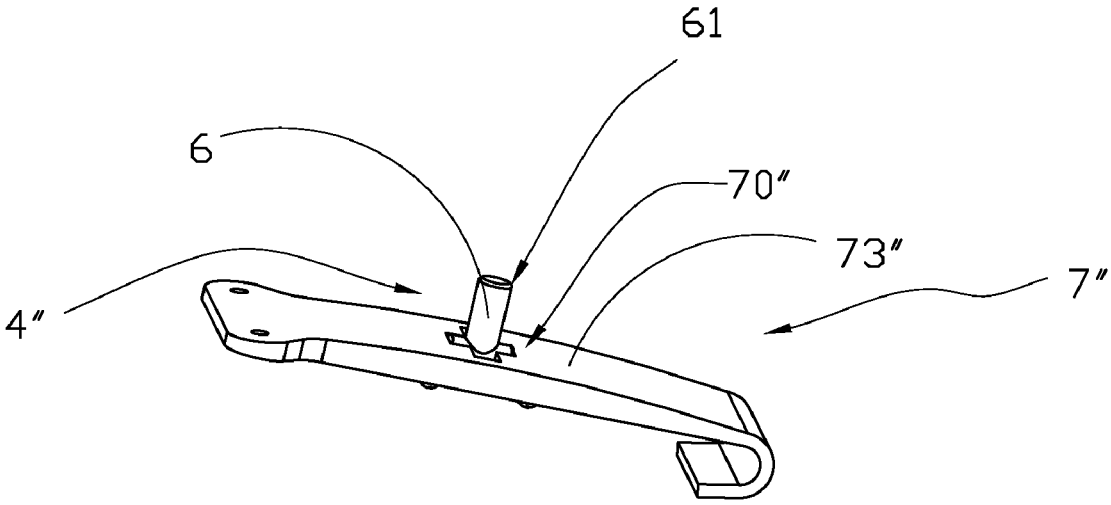
FIG. 5 is a first schematic diagram of the second alternative mode of the multi-functional storage apparatus according to the preferred embodiment of the present invention.
Figure 6:
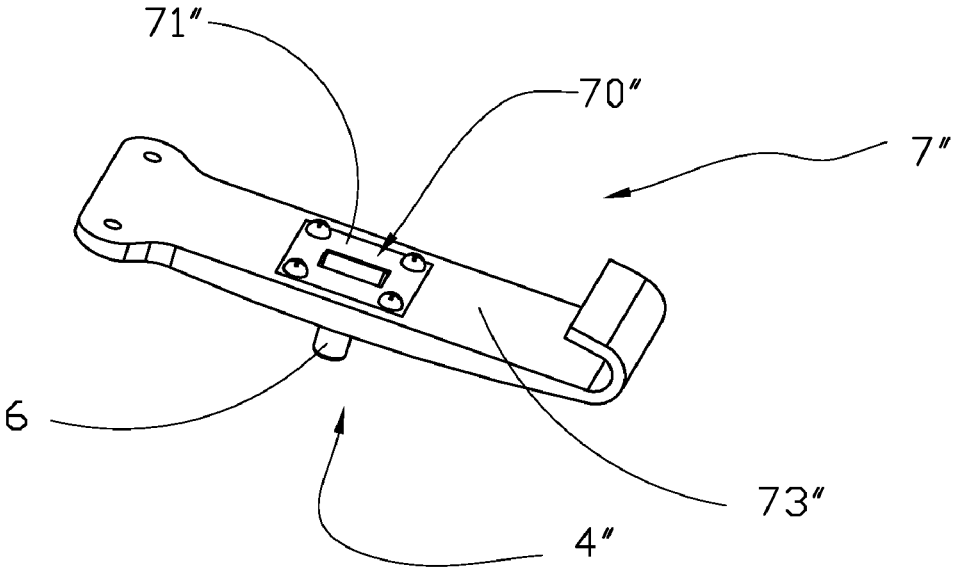
FIG. 6 is a second schematic diagram of the second alternative mode of the multi-functional storage apparatus according to the preferred embodiment of the present invention.
Figure 7:
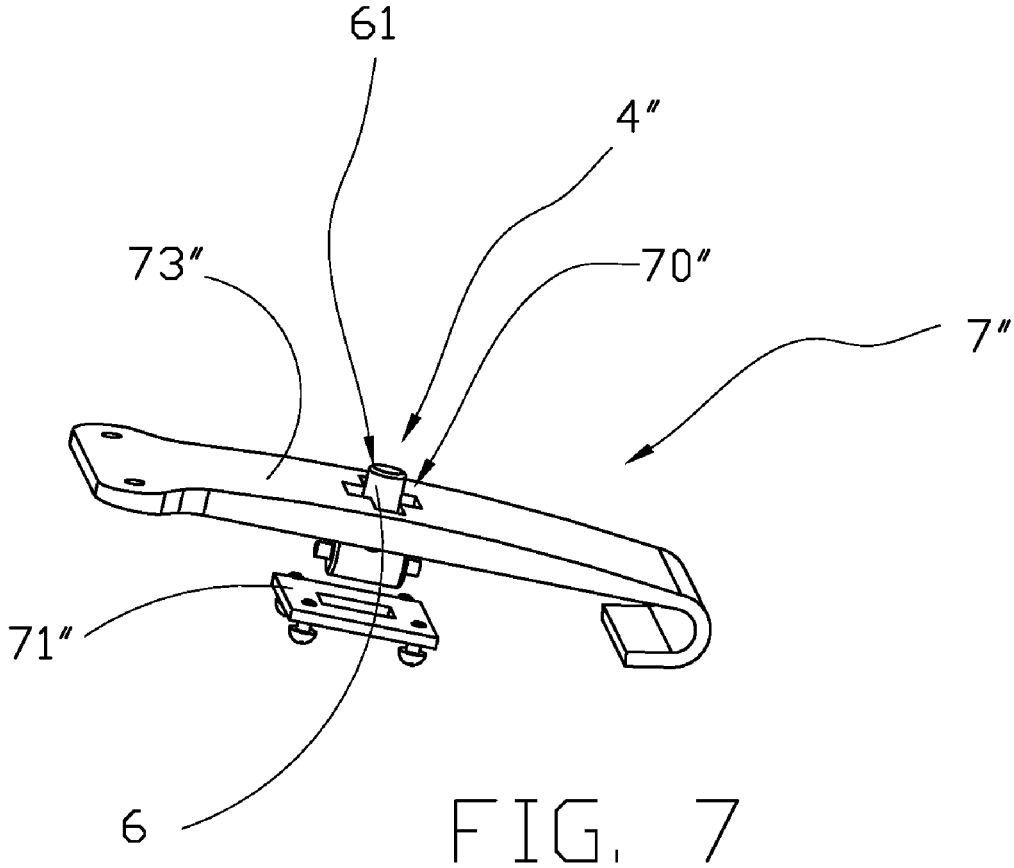
FIG. 7 is a third schematic diagram of the second alternative mode of the multi-functional storage apparatus according to the preferred embodiment of the present invention.
Figure 8:
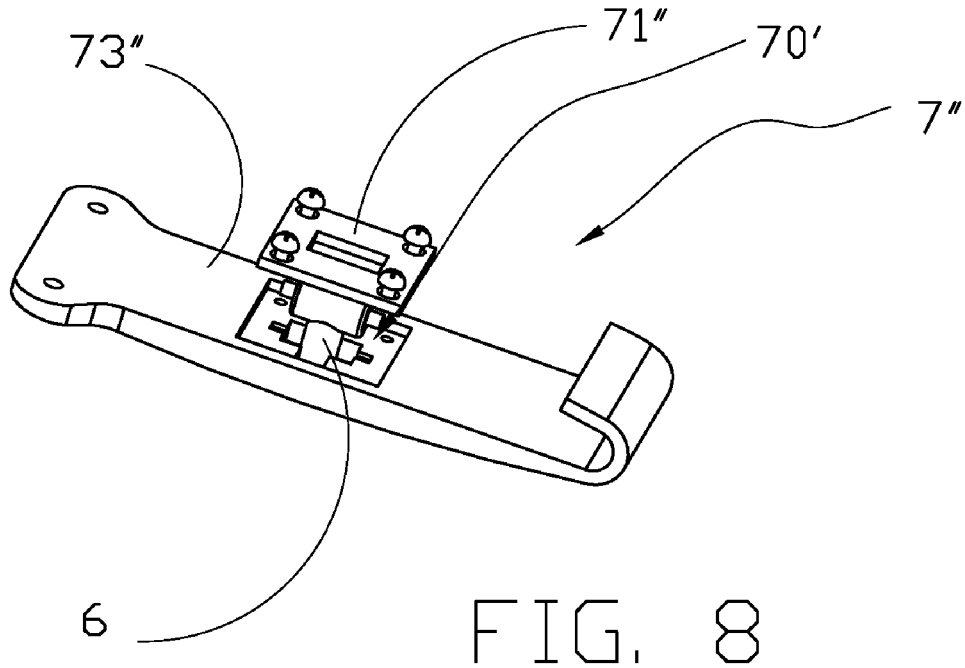
FIG. 8 is a third schematic diagram of the second alternative mode of the multi-functional storage apparatus according to the preferred embodiment of the present invention.

Referring to FIG. 3 of the drawings, a first alternative mode of the multi-functional storage apparatus according to the preferred embodiment of the present invention is illustrated. The first alternative mode is similar to the above-mentioned preferred embodiment, except the supporting frame 4' of the supporting arrangement. According to the first alternative mode, the supporting frame 4' comprises a pivotal support 3' provided on the outer surface (preferably by connecting means 2') of the main casing 1, and a connecting frame 40' pivotally extended from the pivotal support 3' to detachably connect with the capturing device when the main casing 1 is in the capturing mode. More specifically, the pivotal support 3' comprises a plurality of supporting sleeves 31' each having a through holding hole formed thereon for pivotally connecting with the connecting frame 40'.

On the other hand, the connecting frame 40' comprises a main elongated member 401', an outer transverse member 43' integrally and transversely extended from an outer end portion of the main elongated member 401', and an inner transverse latch member 41' integrally and transversely extended from an inner end portion of the main elongated member 401' to pivotally couple with the supporting sleeves 31' of the pivotal support 3' at the holding holes. When the main casing 1 is in the normal storing mode, the connecting frame 40' is pivotally moved to align with the outer surface of the main casing 1 for allowing the main casing 1 to function as a regular portable carrying device. When the main casing 1 is in the capturing mode, the connecting frame 40' is pivotally moved to extend from the pivotal support 3' for detachably connecting with the capturing device.

Accordingly, the connecting frame 40' further has a plurality of screwing teeth 402' formed on an outer end portion of the outer transverse member 43', and an outer end portion of the main elongated member 401' to selectively and detachably engage with a threaded hole of the capturing device. The user is then able to detachably couple the capturing device to either the main elongated member 401' or the outer transverse member 43' to securely and stably capture an image or video at a desired orientation.

Referring to FIG. 4 to FIG. 8 of the drawings, a second alternative mode of the multi-functional storage apparatus according to the preferred embodiment of the present invention is illustrated. The second alternative mode is similar to the above-mentioned preferred embodiment, except that the multi-functional storage apparatus further comprises an elastic clipping member 7" mounted on the main casing 1 for detachably attaching the main casing 1 with the user's body, such as the user's pants. Moreover, the connecting frame 4 is extended from the main casing 1 to detachably attach onto the capturing device. The clipping member 7" has a through hole 70" formed thereon wherein the elongated connecting member 6 is adapted to extend outwardly from the main casing 1 through the through hole 70".

The clipping member 7" comprises a main body 73" having an attaching end portion attached on the outer surface of the main casing 1, wherein the through hole 70" is formed on the main body 73" of the clipping member 7" for allowing the supporting frame 4" passing therethrough. The clipping member 7" further comprises a supporting member 71" provided on an inner surface of the main body 73" for securely connecting with the inner end portion of the elongated connecting member 6 of the supporting frame 4 through the hole 70". According to the third alternative mode of the present invention, the supporting member 71" is rectangular in shape having an elongated slot formed thereon to align with the through hole 70" of the main body 73" of the clipping member 7", wherein the inner end portion of the elongated connecting member 6 is arranged to securely connect with the supporting member 71" via the through hole 70" and the elongated slot of the supporting member 71".

Figure 12:
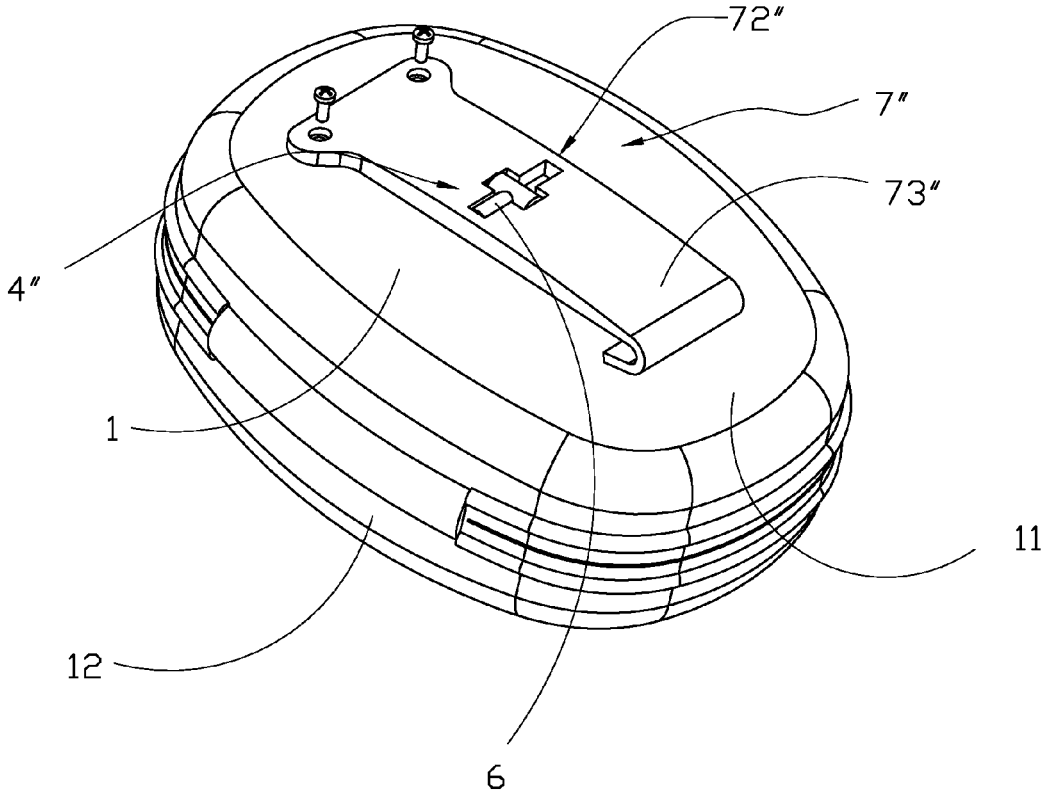
FIG. 12 is a schematic diagram of the multi-functional storage apparatus according to the first alternative mode of the preferred embodiment of the present invention, illustrating that the elongated connecting member can be selectively received into the main casing.

Referring to FIG. 12 of the drawings, in order to enhance an aesthetic appearance of the present invention, a length of the through hole 70" is preferably larger than a diameter of the elongated connecting member 6 which is pivotally connected with the through hole 70" so that when the main casing 1 is in the normal storing mode, the elongated connecting member 6 is adapted to be pivotally moved to be received within the through hole 70". When the main casing 1 is in the capturing mode, the elongated connecting member 6 is adapted to be pivotally moved to extend out from the main casing 1 to detachably attach to the capturing device.

Figure 9:
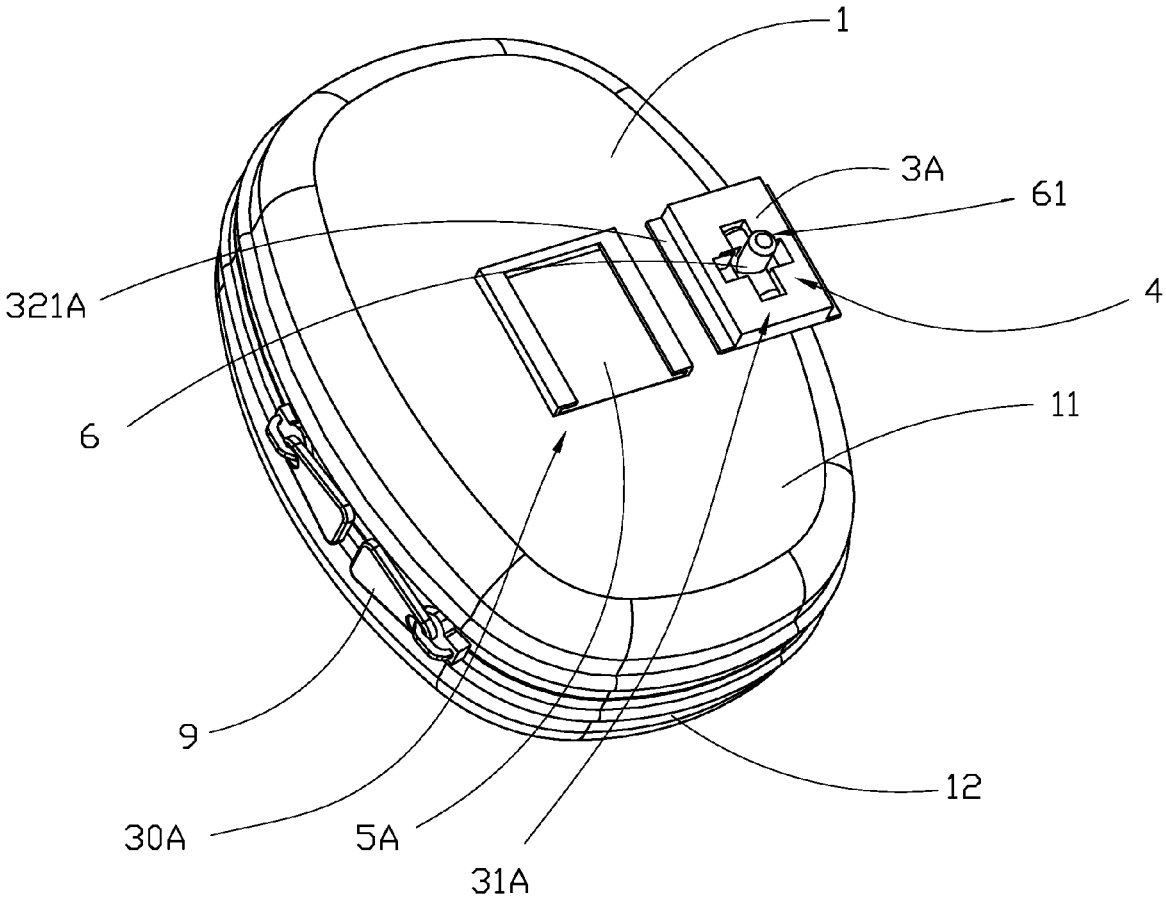
FIG. 9 is a third alternative mode of the multi-functional storage apparatus according to the preferred embodiment of the present invention.
Figure 10:
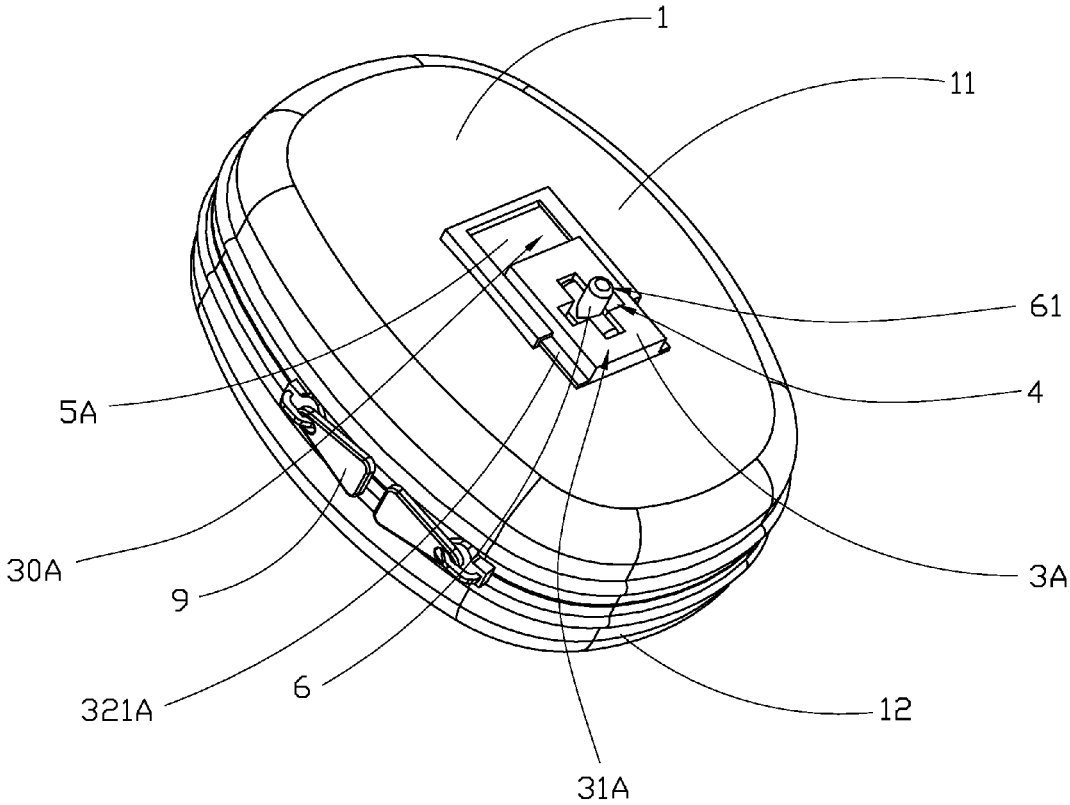
FIG. 10 is a schematic diagram of the third alternative mode of the multi-functional storage apparatus according to the preferred embodiment of the present invention.

Referring to FIG. 9 to FIG. 10 of the drawings, a third alternative mode of the multi-functional storage apparatus according to the preferred embodiment of the present invention is illustrated. The third alternative mode is similar to the above-mentioned preferred embodiment except that the supporting arrangement further comprises a detaching device provided on the main casing 1. According to the third alternative mode, the detaching device comprises a securing member 5A securely mounted on the outer surface of the main casing 1, and a supporting housing 3A, which is connected with the supporting frame 4, detachably coupled with the securing member 5A so as to detachably couple the supporting frame 4 with the main casing 1. More specifically, the securing member 5A has a plurality of engaging slots 30A longitudinally formed on two sides thereof wherein the supporting housing 3A has a plurality of corresponding engaging sleeves 321A formed on two sides thereof for detachably inserting into the engaging slots 30A so as to detachably coupling the securing member 5A with the supporting housing 3A.

Figure 13:
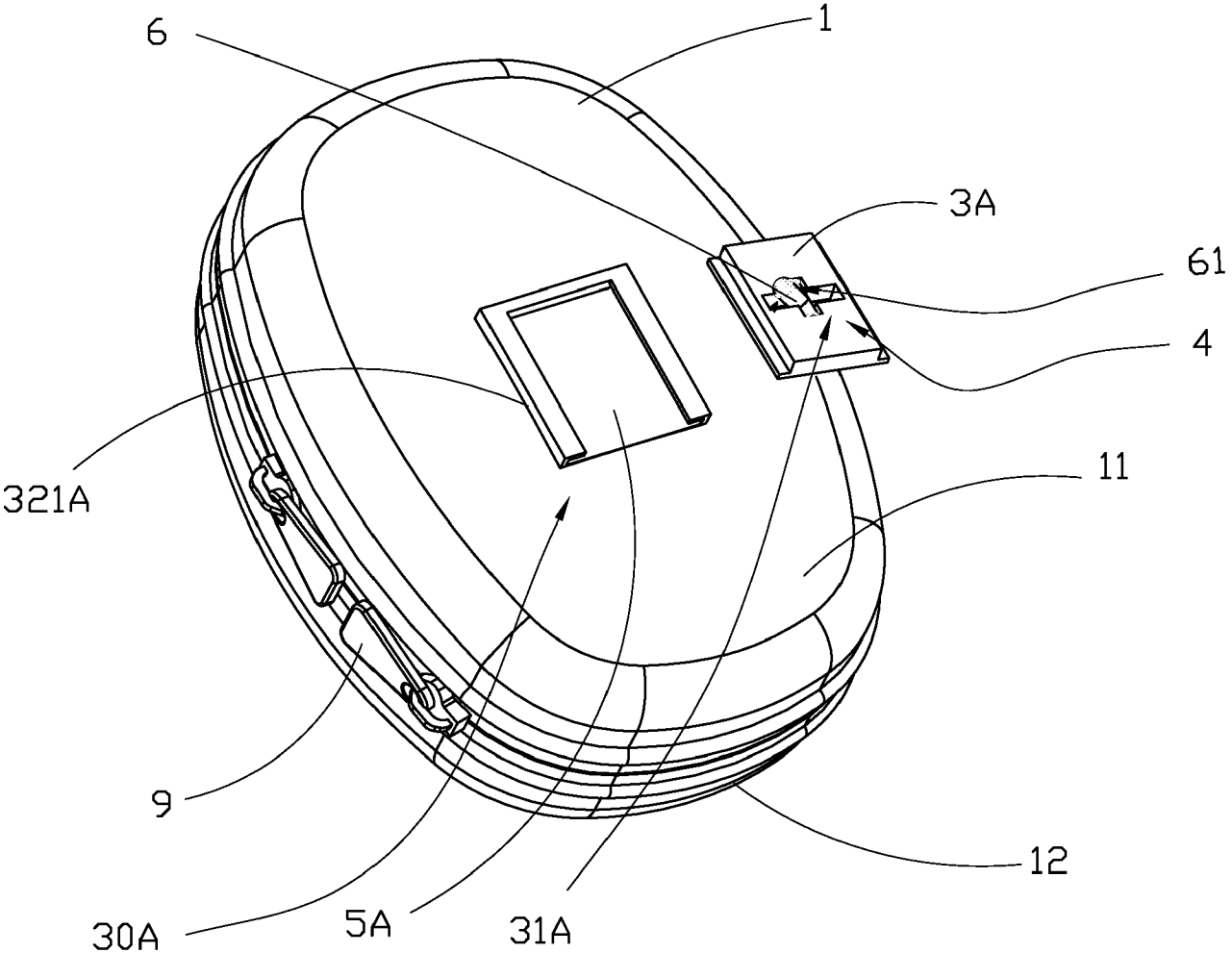
FIG. 13 is a schematic diagram of the multi-functional storage apparatus according to the third alternative mode of the preferred embodiment of the present invention, illustrating that the elongated connecting member can be selectively received into the main casing.

As shown in FIG. 13 of the drawings, the supporting housing 3A has a coupling slot 31A indently formed on a front surface thereof wherein the inner end portion of the elongated connecting member 6 is pivotally connected with the coupling slot 31A of the supporting housing 3A that the elongated connecting member 6 is adapted to outwardly extend from the main casing 1 when the supporting housing 3A is detachably coupled with the securing member 5A.

In order to ensure maximum convenience of using the multi-functional storage apparatus, the coupling slot 31A is indently formed on the supporting housing 3A to normally receive the elongated connecting member 6 within the coupling slot 31A when the main casing 1 is in the normal storing mode. However, when the main casing 1 is in the capturing mode, the elongated connecting member 6 is adapted to be pivotally moved to extend from the supporting housing 3A for securely and stably supporting the capturing device on the main casing 1. As a slight alternative, the elongated connecting member 6 can also be securely (not pivotally) connected to the supporting housing 3A for extending to detachably attach with the capturing device.

One having ordinary skill in the art will understand that the embodiment of the present invention as shown in the drawings and described above is exemplary only and not intended to be limiting. It can be appreciated that the objects of the present invention have been effectively accomplished. The above embodiments have been shown and described for the purposes of illustrating the functional and structural principles of the present invention. Therefore, this invention includes all modifications embraced within the spirit and scope of the following claims.

What is claimed is:

1. A multi-functional storage apparatus for selectively supporting a capturing device, comprising:

a main casing having a receiving cavity formed therein; and a supporting arrangement, which comprises:

a supporting frame operatively extended from an outer surface of said main casing to operate said main casing between a normal storing mode and an capturing mode, wherein in said normal storing mode, said supporting frame is idle on said main casing so as to allow said main casing to function as a portable carrying device through storing objects within said receiving cavity, wherein in said capturing mode, said supporting frame is driven to extend from said main casing to detachably attach to said capturing device for suspendedly and securely supporting said capturing device on said main casing, so that said image capturing device is securely and suspendedly supported by said main casing as a supporting base for stably capturing image in a predetermined direction, wherein said supporting frame comprises an elongated connecting member extended from said supporting housing for detachably attaching on said capturing device when said main casing is in said capturing mode; and a detaching device provided on said main casing, wherein said detaching device comprises:

a securing member securely mounted on said outer surface of said main casing; and a supporting housing which is connected with said supporting frame and is detachably coupled with said securing member so as to detachably couple said supporting frame with said main casing for operating said main casing between said normal storing mode and said capturing mode, wherein said supporting housing has a coupling slot indently formed on a front surface thereof wherein an inner end portion of said elongated connecting member is pivotally connected with said coupling slot of said supporting housing that said elongated connecting member is adapted to outwardly and pivotally extend from said main casing when said supporting housing is detachably coupled with said securing member.

2. The multi-functional storage apparatus, as recited in claim 1, wherein said securing member has a plurality of engaging slots longitudinally formed on two sides thereof whereas said supporting housing has a plurality of corresponding engaging sleeves formed on two sides thereof for detachably inserting into said engaging slots so as to detachably coupling said securing member with said supporting housing.

3. The multi-functional storage apparatus, as recited in claim 1, wherein said elongated connecting member has a threaded outer portion defining a plurality of screwing teeth thereon for detachably coupling with a threaded connecting hole of said capturing device so as to detachably attach onto said capturing device.

4. The multi-functional storage apparatus, as recited in claim 2, wherein said elongated connecting member has a threaded outer portion defining a plurality of screwing teeth thereon for detachably coupling with a threaded connecting hole of said capturing device so as to detachably attach onto said capturing device.

* * * * *